US008973471B2

(12) United States Patent
Hsieh

(10) Patent No.: US 8,973,471 B2
(45) Date of Patent: Mar. 10, 2015

(54) THREE-PROTUBERANCE OPEN-END WRENCH

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 325 days.

(21) Appl. No.: 13/349,391

(22) Filed: Jan. 12, 2012

(65) Prior Publication Data

US 2013/0014614 A1 Jan. 17, 2013

(30) Foreign Application Priority Data

Jul. 15, 2011 (TW) ..... 100125838 A

(51) Int. Cl.

| | |
|---|---|
| ***B25B 13/02*** | (2006.01) |
| ***B25B 13/00*** | (2006.01) |
| ***B25B 13/08*** | (2006.01) |
| ***B25B 13/04*** | (2006.01) |
| ***B25B 13/06*** | (2006.01) |

(52) U.S. Cl.

CPC ..... *B25B 13/08* (2013.01); *B25B 13/04* (2013.01); *B25B 13/065* (2013.01)

USPC ..... 81/119; 81/186

(58) Field of Classification Search

CPC ..... B25B 13/08; B25B 13/065

USPC ..... 81/186, 119

See application file for complete search history.

(56) References Cited

U.S. PATENT DOCUMENTS

| | | | | |
|---|---|---|---|---|
| 736,687 | A * | 8/1903 | Chandler | 81/119 |
| 4,011,778 | A * | 3/1977 | Delin | 81/186 |
| 5,074,171 | A * | 12/1991 | Annis et al. | 81/119 |
| 5,148,726 | A * | 9/1992 | Huebschen et al. | 81/119 |
| 5,904,076 | A * | 5/1999 | Siwy | 81/121.1 |
| 5,996,449 | A | 12/1999 | Hsieh | |
| 6,009,778 | A | 1/2000 | Hsieh | |
| 6,145,414 | A | 11/2000 | Hsieh | |
| 6,755,098 | B2 * | 6/2004 | Huang | 81/119 |
| 7,168,347 | B2 | 1/2007 | Hsieh | |

FOREIGN PATENT DOCUMENTS

| | | |
|---|---|---|
| TW | 319139 | 11/1997 |

* cited by examiner

*Primary Examiner* — Bryan R Muller
(74) *Attorney, Agent, or Firm* — Guice Patents PLLC

(57) ABSTRACT

A three-protuberance open-end wrench includes a head section. The head section has a first jaw and a second jaw. Two first protuberances are front and rear, side by side, formed on a holding face of the first jaw. A second protuberance is formed on a holding face of the second jaw. A throat is formed between the holding faces of the first and second jaws for receiving a threaded member therein. The protuberances of the first and second jaws serve to hold the threaded member. The protuberances form a non-isosceles triangle.

10 Claims, 5 Drawing Sheets

THREE-PROTUBERANCE OPEN-END WRENCH

BACKGROUND OF THE INVENTION

1. Field of the Invention

The present invention relates generally to an open-end wrench, and more particularly to an open-end wrench, which is applicable to both an ordinary bolt and a worn bolt.

2. Description of the Related Art

A conventional open-end wrench has two jaws. The two jaws respectively have two holding plane faces in parallel to each other for holding and wrench an ordinary hexagonal bolt. The holding plane faces can be toothed to provide larger wrenching force. However, such wrench can hardly wrench a worn bolt. This is because the head section of the worn bolt is irregularly blunt. When making the holding plane faces of the jaws of the open-end wrench abut against the head section of the bolt to wrench the same, the holding plane faces are likely to slip over the corners of the head section of the bolt. Therefore, it is inconvenient to use such open-end wrench.

Taiwanese Patent Publication No. 319139 discloses an antislip open-end wrench as shown in FIG. 1. The head section of the open-end wrench 1 has a first jaw 11, a second jaw 12 and a bottom 13. Two recesses are formed on an inner face of the first jaw 11 in a position spaced from a free end of the first jaw 11 by a certain length and in a position close to the bottom 13 respectively. A boss section 111 is defined between the two recesses. Two arcuate protuberance sections 121 are formed on an inner face of the second jaw 12. A worn bolt head 3 can be held between the first and second jaws 11, 12 of the open-end wrench 1. The bolt head 3 has a width L. The inscribed circle of the bolt head 3 has a radius R. When making the inner faces of the jaws of the open-end wrench abut against the bolt head 3 to wrench the same, the effort point of the boss section 111 to the bolt head 3 will move so that the boss section 111 will still slip over the corners of the bolt head 3. Moreover, with respect to different bolts worn to different extents, the effort point of the boss section 111 can be hardly fixed. As a result, the boss section 111 is very likely to slip over the corners of the bolt head.

Therefore, it is inconvenient to use such open-end wrench. It is therefore tried by the applicant to provide a wrench, which is applicable to both an ordinary bolt and a worn bolt to easily wrench the same.

SUMMARY OF THE INVENTION

It is therefore a primary object of the present invention to provide a three-protuberance open-end wrench, which is applicable to both an ordinary hexagonal bolt to more easily wrench the bolts, for user-friendly manipulation.

It is a further object of the present invention to provide the above three-protuberance open-end wrench, which can provide fixed effort points on the bolt to minimize the possibility of slippage.

To achieve the above and other objects, the three-protuberance open-end wrench of the present invention includes a head section. The head section has a first jaw and a second jaw. A throat is formed between the holding faces of the first and second jaws for receiving a threaded member therein. The open-end wrench is characterized in that two first protuberances are front-and-rear side by side formed on the holding face of the first jaw. A second protuberance is formed on the holding face of the second jaw. The second protuberance of the second jaw is not positioned in a central bisector of the two first protuberances of the first jaw. Two lateral sides of the threaded member are respectively held by the protuberances of the first and second jaws.

Still to achieve the above and other objects, the three-protuberance open-end wrench of the present invention includes a head section. The head section has a first jaw and a second jaw. Two first protuberances are front-and-rear side by side formed on a holding face of the first jaw. A second protuberance is formed on a holding face of the second jaw. A throat is formed between the holding faces of the first and second jaws for receiving a threaded member therein. The protuberances of the first and second jaws serve to hold two lateral sides of the threaded member. The protuberances form a non-isosceles triangle.

The present invention can be best understood through the following description and accompanying drawings, wherein:

DETAILED DESCRIPTION OF THE PREFERRED EMBODIMENTS

Figure 1:
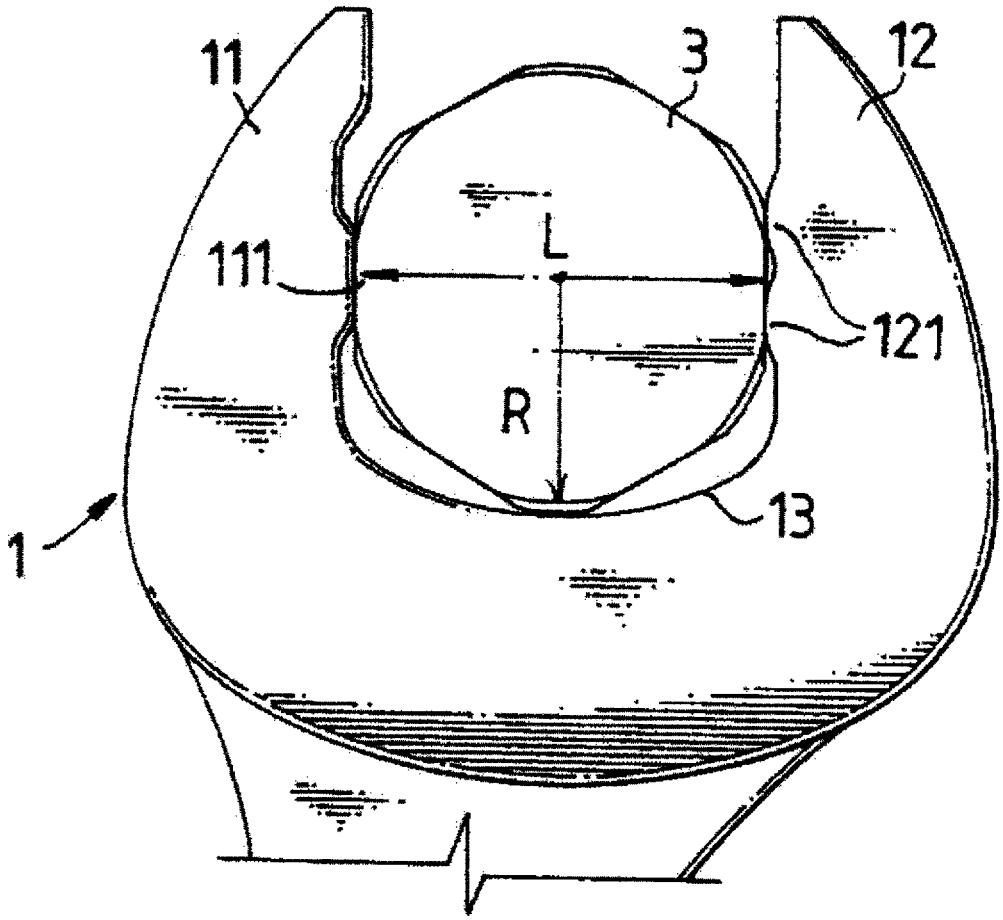
Fig.1 PRIOR ART
FIG. 1 is a front view showing that a conventional open-end wrench is used to wrench a worn bolt.
Figure 2:
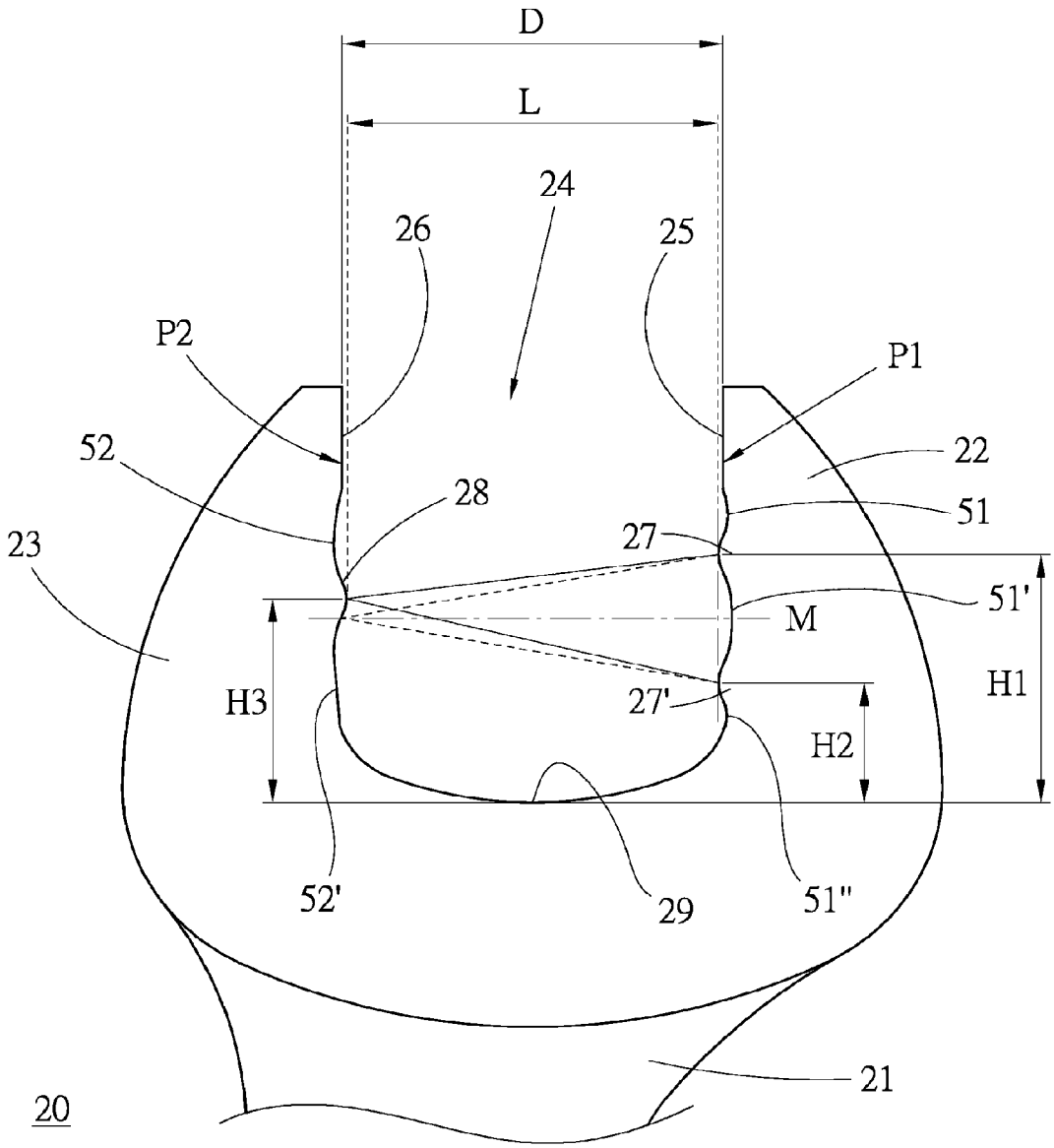
FIG. 2 is a front view of the open-end wrench of the present invention.
Figure 3:
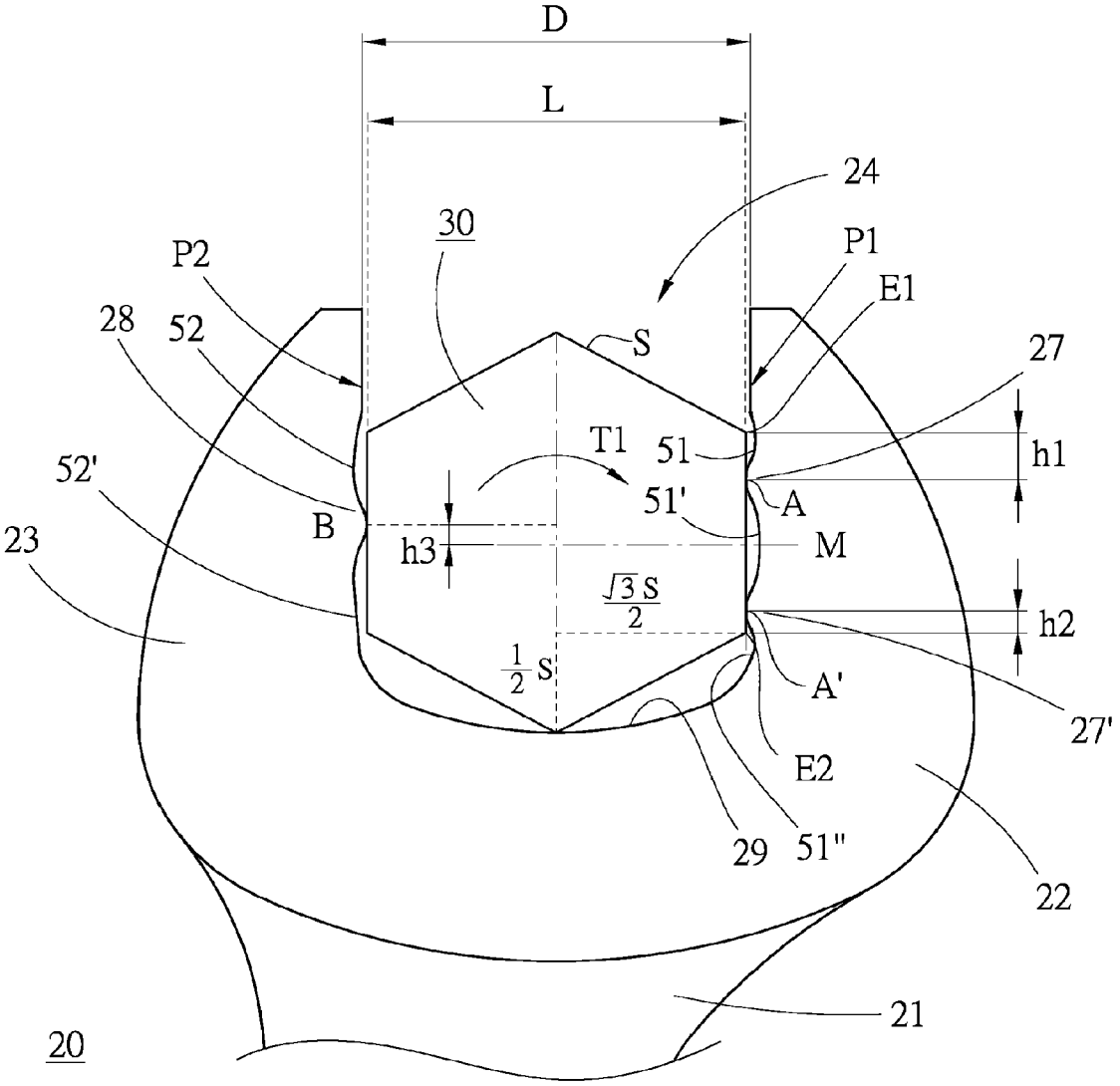
FIG. 3 is a front view of the open-end wrench of the present invention, showing that the open-end wrench is used to wrench an ordinary bolt.
Figure 5:
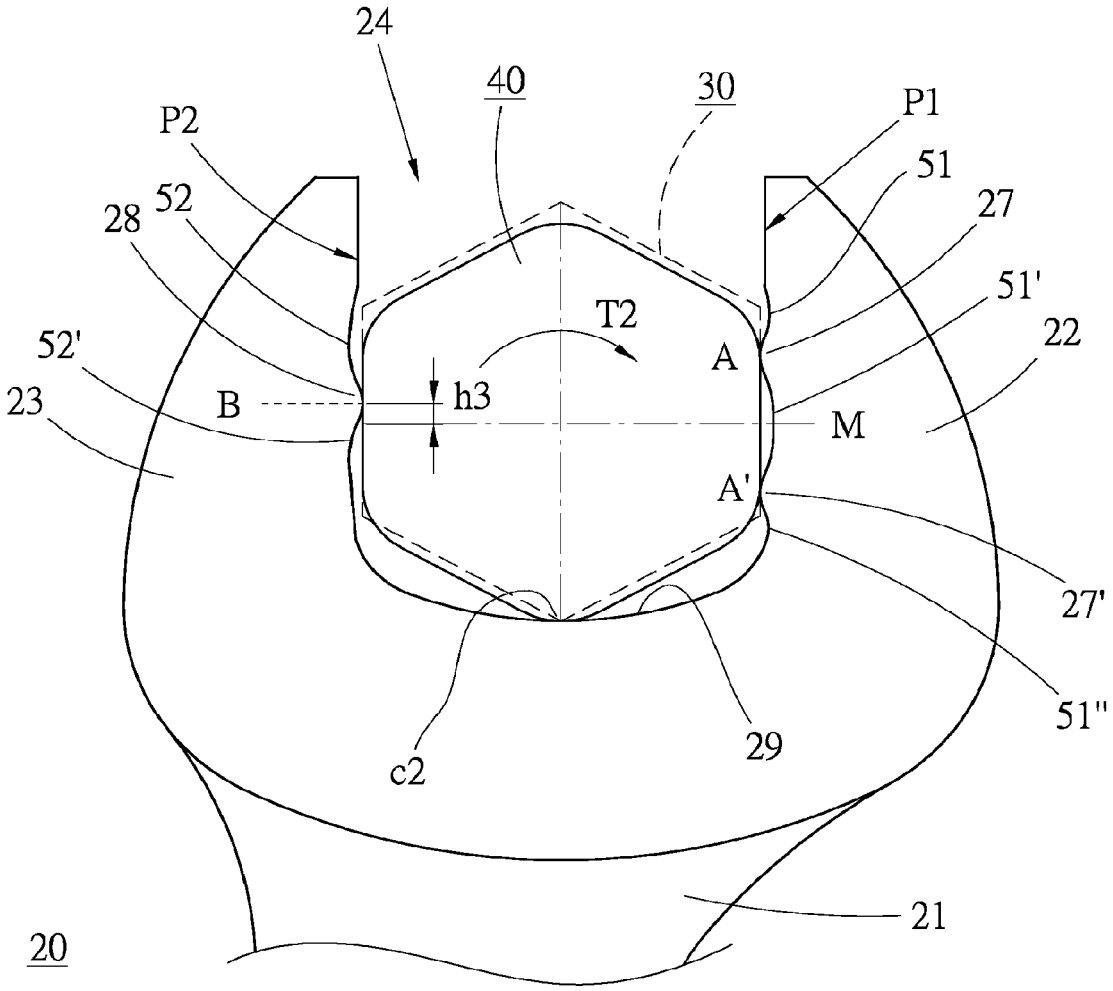
FIG. 5 is a front view of the open-end wrench of the present invention, showing that the open-end wrench is used to wrench the worn bolt.

Please refer to FIGS. 2, 3, and 5. According to a preferred embodiment, the three-protuberance open-end wrench 20 of the present invention includes a handle (not shown) and at least one head section 21. The head section 21 includes a first jaw 22 and a second jaw 23. The first jaw 22 has a first planar surface P1, while the second jaw 23 has a second planar surface P2. The first planar surface P1 and the second planar surface P2 are parallel and are separated a distance D. The first planar surface P1 includes a first holding face 25, two first protuberances 27, 27' and three first recesses 51, 51', 51". The second planar surface P2 includes a second holding face 26, a second protuberance 28 and two second recesses 52, 52'. The first holding face 25 and the second holding face 26 are parallel. The two first protuberances 27, 27' protrude inwardly above the first planar surface P1 toward a center of the head section 21. The second protuberance 28 protrudes inwardly above the second planar surface P2 toward the center of the head section 21. The three first recesses 51, 51', 51" protrude outwardly below the first planar surface P1 away from the center of the head section 21. The two second recesses 52, 52' protrude outwardly below the second planar surface P2 away from the center of the head section 21. A throat 24 is formed between the first and second holding faces 25, 26 of the two jaws 22, 23.

The two first protuberances 27, 27' inward protruded from the first holding face 25 are front and rear, side by side formed. A front one of the first protuberances 27 is close to the opening of the throat 24. The distance between the front first protuberance 27 and a bottom side 29 of the throat 24 is defined as H1. A rear one of the first protuberances 27' is close to the bottom side 29 of the throat 24. The distance between the rear first protuberance 27' and the bottom side 29 of the throat 24 is defined as H2. The second protuberance 28 inward protruded from the second holding face 26 is formed. The distance between the second protuberance 28 and the bottom side 29 of the throat 24 is defined as H3. The second protuberance 28 of the second jaw 23 is not positioned in a central bisector M of the two first protuberances 27, 27' of the first jaw 23. Therefore, the triangle formed of the protuberances 27, 27', 28 is asymmetrical, that is, is a non-isosceles triangle.

Referring to FIG. 3, the throat 24 has a working width L for receiving a threaded member. The working width L is the distance between the protuberances of the two jaws. A bottom end of the threaded member abuts against the bottom side 29 of the throat. In this embodiment, the threaded member is an ordinary hexagonal bolt 30 for illustration purposes only.

The first protuberances 27, 27' of the first jaw 22 and the second protuberance 28 of the second jaw 23 together hold two lateral sides of the hexagonal bolt 30, at which three holding points A, A' and B are defined respectively. The lateral side of the hexagonal bolt 30, which is held by the first protuberances 27, 27', is defined with a front end point E1 and a rear end point E2. The distance between the front end point E1 and the holding point A is h1. The distance between the rear end point E2 and the holding point A' is h2. The distance h1 is larger than the distance h2. The distance between the holding point B and the central bisector M of the two holding points A, A' is h3. The holding point B is offset from the central bisector M to on one hand, ensure force balance relationship between the holding points A, A', B and always keep the force unified. For example, the effort point to the threaded member can be always kept in the same position so as to minimize the possibility of slippage of the bolt. On the other hand, a moment T1 is created by the offset between the holding point B and the central bisector M of the two holding points A, A' to increase the wrenching force applied to the hexagonal bolt 30.

In this embodiment, the second protuberance 28 of the second jaw 23 is positioned above the central bisector M of the two first protuberances 27, 27' of the first jaw 22, that is, positioned between the central bisector M and the first protuberance 27. Alternatively, the second protuberance 28 of the second jaw 23 can be positioned below the central bisector M of the two first protuberances 27, 27'.

In this embodiment, the hexagonal bolt 30 has a side length S. The width of the hexagonal bolt 30 is equal to the working width L of the throat 24, that is, $\sqrt{3}S$ (about 1.73 S).

Figure 4:
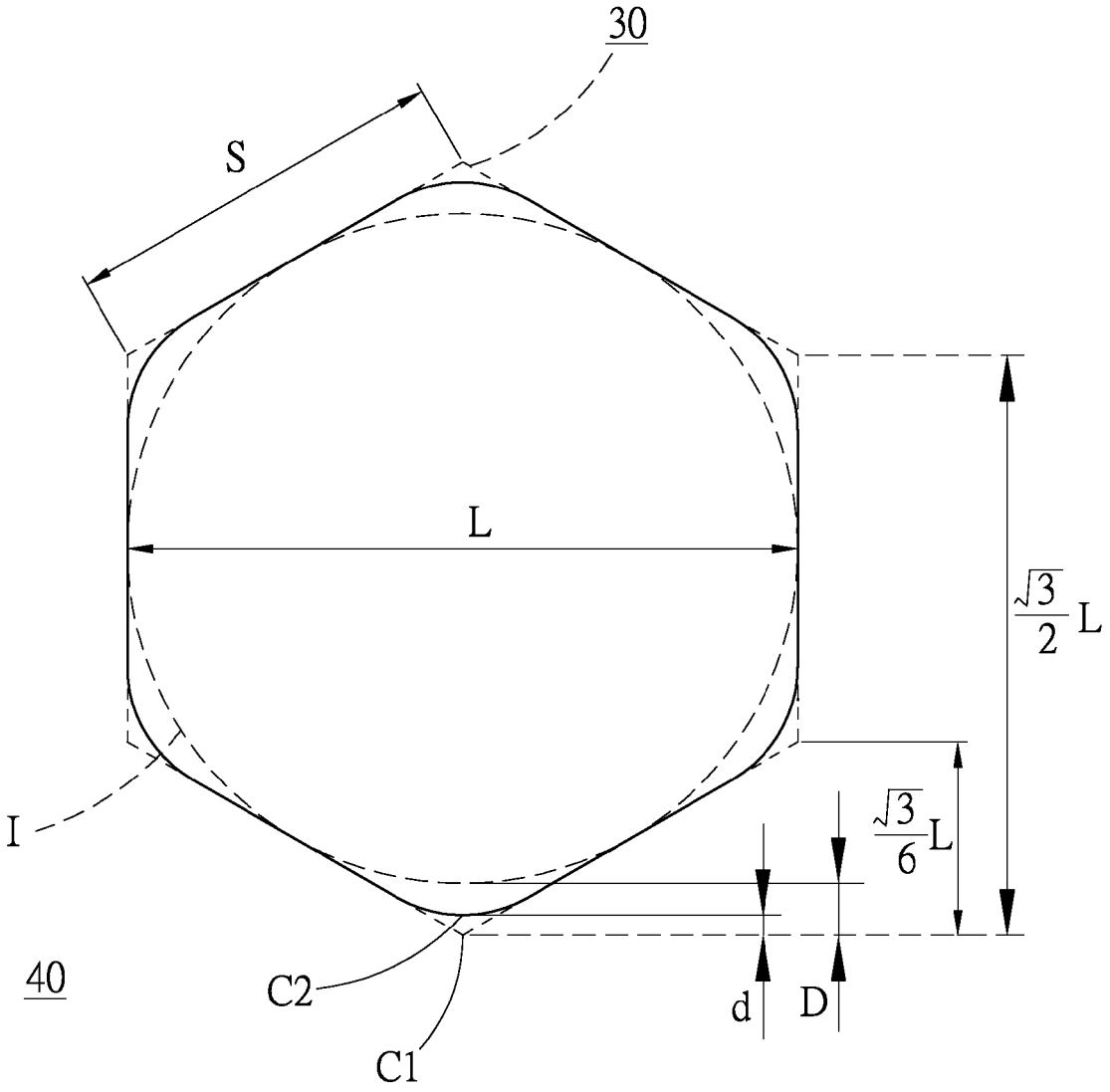
FIG. 4 is an enlarged top view of a worn bolt.

FIG. 4 shows a worn bolt 40. In comparison with an ordinary hexagonal bolt 30, the corners of the bolt 40 are worn and blunted. The wear ratio of the worn bolt 40 can be calculated and obtained on the basis of the distance D between the inscribed circle I of the hexagonal bolt 30 and the bottom end C1 and the wear distance d of the worn bolt 40. Provided that the worn bolt 40 has a wear ratio x, then the wear ratio $x=(d/D)*100\%$, wherein $D=[1-(\sqrt{3}/2)]S$, $S=(\sqrt{3}/3)$ L. Accordingly, D is about 0.077 L.

The distance h3 between the holding point B and the central bisector M of the two holding points A, A' is larger than the wear distance d of the bolt.

In the preferred embodiment of the present invention, the three-protuberance open-end wrench is applicable to a worn bolt 40 with a wear ratio up to about 40%, which can cover most of the wear states of the bolts. In the case that the wear ratio is 40%, the wear distance d is about 0.031 L. The bottom end C2 of the worn bolt 40 abuts against the bottom side 29 of the throat to provide a secure wrenching condition. Accordingly, when applied to the worn bolt 40, the distance between the front first protuberance 27 of the first jaw 22 and the bottom side 29 of the throat is preferably not larger than 0.834 L. The distance between the rear first protuberance 27' of the first jaw 22 and the bottom side 29 of the throat 24 is preferably not smaller than 0.257 L.

In addition, the distance between the second protuberance 28 of the second jaw 23 and the bottom side 29 of the throat 24 can range from 0.257 L to 0.834 L. In this embodiment, the distance ranges from 0.577 L to 0.834 L. Preferably, the second protuberance 28 is formed in a position spaced from the bottom side 29 of the throat 24 by a distance of 0.706 L.

According to the above arrangement, by means of the offset between the holding point B and the central bisector M, the open-end wrench of the present invention is applicable to both an ordinary hexagonal bolt 30 and a worn bolt 40 to provide fixed effort points in the form of an asymmetrical triangle. This minimizes the possibility of slippage and makes it easier to wrench the bolt.

Moreover, as shown in FIGS. 3 and 5, the holding point B is kept spaced from the central bisector M by a distance h3 to create moments T1, T2 for increasing the wrenching force applied to the threaded member. Accordingly, the threaded member can be more easily wrenched.

The above embodiments are only used to illustrate the present invention, not intended to limit the scope thereof. Many modifications of the above embodiments can be made without departing from the spirit of the present invention.

What is claimed is:

1. A three-protuberance open-end wrench configured for use with a threaded member, the three-protuberance open-end wrench comprising: a head section, the head section including a first jaw and a second jaw, a throat being formed between the first jaw and the second jaw for receiving the threaded member therein, the first jaw has a first planar surface and the second jaw has a second planar surface, the first planar surface and the second planar surface communicating with the throat, each planar surface of the first planar surface and the second planar surface including a holding face, at least one recess, and at least one protuberance, the at least one recess extending below the planar surface away from the throat and the at least one protuberance extending above the planar surface, the first planar surface of the first jaw is parallel with the second planar surface of the second jaw; the at least one protuberance consisting of three protuberances being two first protuberances located on the first jaw and a second protuberance located on the second jaw, the two first protuberances protruding outwardly from the first planar surface of the first jaw toward the second jaw, each of the two first protuberances has a first holding point being spaced apart from the holding face of the first jaw, the second protuberance protruding outwardly from the second planar face of the second jaw toward the first jaw and having a second holding point being spaced apart from the holding face of the second jaw, a central bisector is a line extending perpendicular from the first jaw toward the second jaw in a position centered between the two first protuberances, the second protuberance is located between the two first protuberances, a center of the second protuberance is offset from and not aligned with the central bisector of the two first protuberances of the first jaw, the threaded member having a first lateral side and a second lateral side being respectively held by the protuberances of the first jaw and the second jaw.

2. The three-protuberance open-end wrench as claimed in claim 1, wherein an apex of each of the two first protuberances and the second protuberance form a non-isosceles triangle.

3. The three-protuberance open-end wrench as claimed in claim 1, wherein the second protuberance of the second jaw is positioned between the central bisector of the two first protuberances of the first jaw and the front first protuberance.

4. The three-protuberance open-end wrench as claimed in claim 1, wherein the throat has a working width L, the working width L being a distance between the first protuberances and the second protuberance of the jaws, a distance between the front first protuberance and a bottom side of the throat being not larger than 0.834 L.

5. The three-protuberance open-end wrench as claimed in claim 4, wherein a distance between the rear first protuberance and the bottom side of the throat is not smaller than 0.257 L.

6. The three-protuberance open-end wrench as claimed in claim 4, wherein a distance between the second protuberance and the bottom side of the throat ranges from 0.577 L to 0.834 L.

7. The three-protuberance open-end wrench as claimed in claim 3, wherein the throat has a working width L, the working width L being a distance between the first protuberances and the second protuberance of the jaws, a distance between the front first protuberance and a bottom side of the throat being not larger than 0.834 L.

8. The three-protuberance open-end wrench as claimed in claim 7, wherein a distance between the rear first protuberance and the bottom side of the throat is not smaller than 0.257 L.

9. The three-protuberance open-end wrench as claimed in claim 7, wherein a distance between the second protuberance and the bottom side of the throat is about 0.706 L.

10. A three-protuberance open-end wrench configured for use with a threaded member, the three-protuberance open-end wrench comprising: a head section, the head section including a first jaw and a second jaw, a throat being formed between the first jaw and the second jaw for receiving the threaded member therein, the first jaw has a first planar surface and the second jaw has a second planar surface, the first planar surface and the second planar surface communicating with the throat, each planar surface of the first planar surface and the second planar surface including a holding face, and at least one protuberance, the at least one protuberance extending above the planar surface toward the throat, the first planar surface of the first jaw is parallel with the second planar surface of the second jaw; the at least one protuberance consisting of three protuberances being two first protuberances located on the first jaw and a second protuberance located on the second jaw, the two first protuberances protruding outwardly from the first planar surface of the first jaw toward the second jaw, each of the two first protuberances has a first holding point being spaced apart from the holding face of the first jaw, the second protuberance protruding outwardly from the second planar face of the second jaw toward the first jaw and having a second holding point being spaced apart from the holding face of the second jaw, a central bisector is a line extending perpendicular from the first jaw toward the second jaw in a position centered between the two first protuberances, the second protuberance is located between the two first protuberances, a center of the second protuberance is offset from and not aligned with the central bisector of the two first protuberances of the first jaw, the threaded member having a first lateral side and a second lateral side being respectively held by the protuberances of the first jaw and the second jaw.

* * * * *